US011476064B1

(12) United States Patent
Worsham

(10) Patent No.: US 11,476,064 B1
(45) Date of Patent: Oct. 18, 2022

(54) ROTOR FOR MULTI-POLE ROTARY ELECTRICAL SWITCHES

(71) Applicant: David Worsham, Santa Rosa Beach, FL (US)

(72) Inventor: David Worsham, Santa Rosa Beach, FL (US)

( * ) Notice: Subject to any disclaimer, the term of this patent is extended or adjusted under 35 U.S.C. 154(b) by 66 days.

(21) Appl. No.: 17/189,332

(22) Filed: Mar. 2, 2021

(51) Int. Cl.
*H01H 19/20* (2006.01)
*H01H 19/14* (2006.01)

(52) U.S. Cl.
CPC ..... *H01H 19/20* (2013.01); *H01H 19/14* (2013.01)

(58) Field of Classification Search
CPC ..... H01H 19/20; H01H 19/14; H01H 3/08; H01H 19/46; H01H 2221/01; H01H 19/10
See application file for complete search history.

(56) References Cited

U.S. PATENT DOCUMENTS 7,442,887 B2 * 10/2008 Graham ..... H01H 19/08 200/336
2017/0352505 A1 * 12/2017 Wang ..... H01H 19/14
2021/0035763 A1 * 2/2021 Montgomery ..... H01H 19/52

* cited by examiner

*Primary Examiner* — Lheiren Mae A Caroc
(74) *Attorney, Agent, or Firm* — Lanier Ford Shaver & Payne, PC; Gerald M. Walsh

(57) ABSTRACT

A rotor system for a multi-pole rotary electrical switch having a rotor with a top and a bottom. Bus plate connectors are held in chambers on the bottom of the rotor. Retainers in the chambers, engaging only sides of the bus plate connectors, prevent the bus plate connectors from dropping out of the chambers when the bus plate connectors are placed above bus plates in a bus plate holder to place the switch in an "OFF" position. Support members extend from a side of the rotor to support the bus plate connectors above the bus plates. When the rotor is rotated to the "OFF" position the support members are rotated up onto support posts positioned in the bus plate holder. When the rotor is rotated to an "ON" position the support members are rotated off the support posts and the bus plate connectors are pressed down against the bus plates by a spring, thereby creating electrical connections between the bus plate connectors and the bus plates.

12 Claims, 12 Drawing Sheets

ROTOR FOR MULTI-POLE ROTARY ELECTRICAL SWITCHES

FIELD OF THE INVENTION

The present invention is related to electrical switches and, more particularly, to a rotor for multi-pole rotary electrical switches.

BACKGROUND OF THE INVENTION

Electrical switches are useful in providing electrical power to a plurality of pathways from energy sources, such as batteries, to various electrically driven devices. U.S. Pat. No. 7,442,887 discloses a rotary electrical switch for simultaneously turning on or turning off two distinctly separate and isolated electrical circuits and providing a second option of connecting the two separate circuits together. This is accomplished with a rotor keyed with an external knob used to control rotational position of the rotor. The rotor has two electrically conductive link bars that electrically couple with two or four of the stationary bus bars, dependent upon a rotational position of the rotor. Each bus bar is electrically connected to an electrical terminal. However, when the external knob is in an "OFF" position the link bars still make electrical contact with two of the stationary bus bars. A safer configuration would be to have the link bars make no contact with the bus bars in an "OFF" position of the external knob.

SUMMARY OF THE INVENTION

The present invention provides a rotor system for a multi-pole rotary electrical switch having a rotor with a top surface and a bottom surface with a keyed member on the top surface, the keyed member having an interior. One or two bus plate connectors are held in chambers on the bottom surface of the rotor. Retainers in the chambers are constructed to engage the bus plate connectors only at the sides of the bus plate connectors. The retainers are constructed to prevent the bus plate connectors from dropping out of the chambers when the bus plate connectors are placed above bus plates in a bus plate holder. When the bus plate connectors are placed above bus plates the multi-pole rotary electrical switch is in an "OFF" position in which there are no electrical connections between the bus plate connectors and the bus plates.

A first support member extends from a first side of the rotor and a second support member extending from an opposite side of the rotor to support the bus plate connectors above the plates in the bus plate holder. The first support member and the second support member are constructed so that when the rotor is rotated to the "OFF" position the first support member and the second support member are rotated onto a first support post and onto a second support post, respectively, in the bus plate holder. The first support member and the second support member are constructed so that when the rotor is rotated to an "ON" position the first support member and the second support member are rotated off the first support post and the second support post, respectively, and the bus plate connectors are pressed against the bus plates by a spring in the interior of the keyed member, thereby making electrical connections between the bus plate connectors and the bus plates.

Sides of the bus plate connectors having receptacles to engage the retainers. Each retainer has a lip member that engages a ledge in the receptacle.

An advantage of the present invention is bus plate connectors suspended over the bus plates when the multi-pole rotary electrical switch is in the off position and there are no electrical connections of the bus plate connectors to the bus plates.

Another advantage is support members on the rotor that are rotated onto support posts in the bus plate holder to position the multi-pole rotary electric switch into an off position and that are rotated off of the support posts to position the multi-pole rotary electric switch into an on position.

Another Advantage is a rotor system that makes assembly of a multi-pole rotary electrical switch easier by retaining the bus plate connectors in the rotor regardless of the orientation of the rotor.

DETAILED DESCRIPTION OF THE INVENTION

While the following description details the preferred embodiments of the present invention, it is to be understood that the invention is not limited in its application to the details of arrangement of the parts or steps of the methods illustrated in the accompanying figures, since the invention is capable of other embodiments and of being practiced in various ways.

Figure 1:
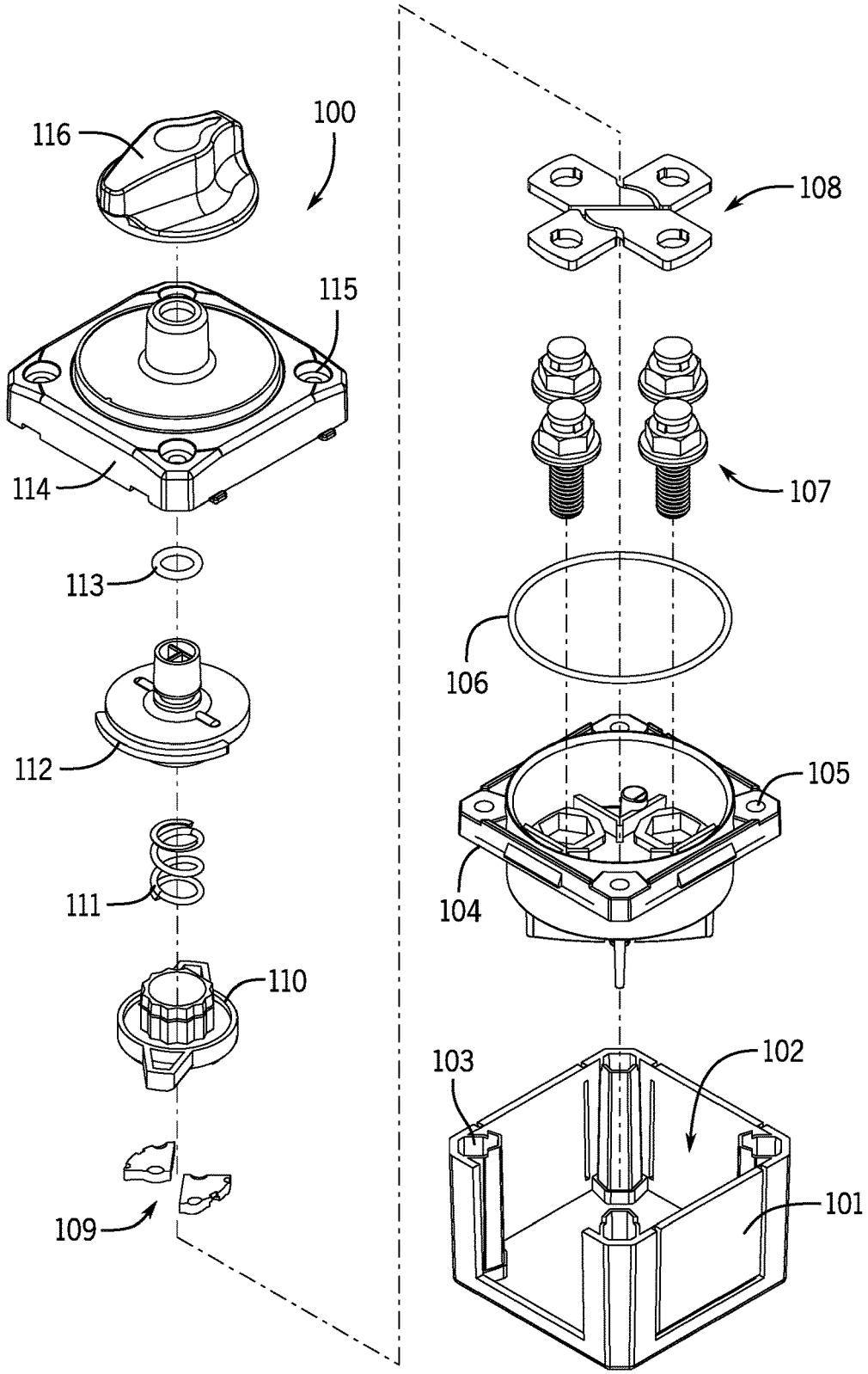
FIG. 1 shows an exploded view of the rotary switch of the present invention.
Figure 2:
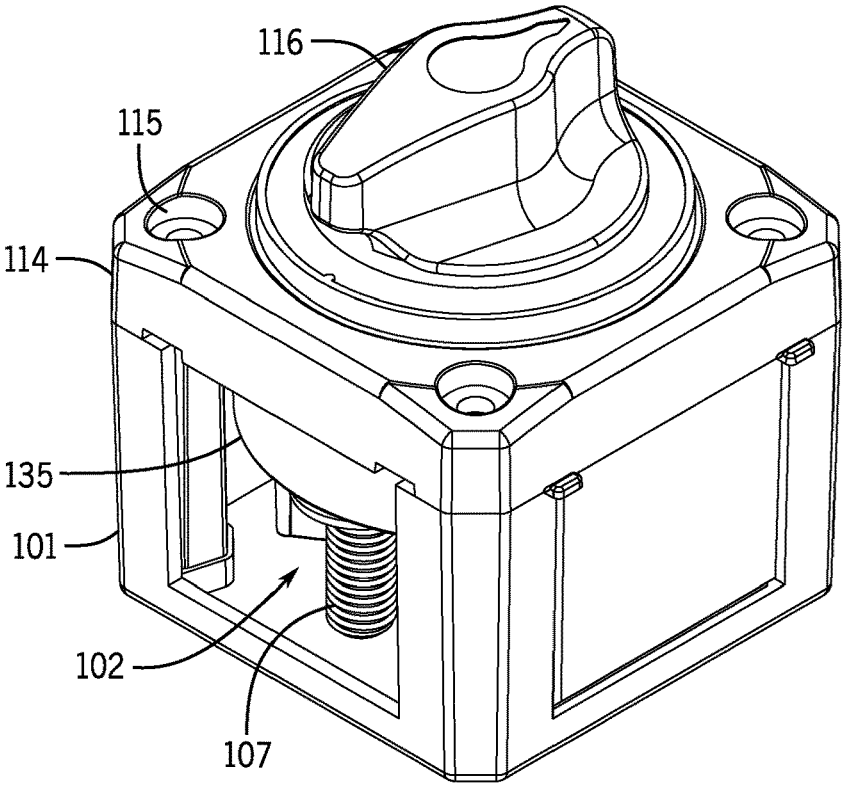
FIG. 2 shows a top, front, right side perspective view of the rotary switch.

FIG. 1 shows an exploded view of the rotary switch 100 of the present invention. The rotary switch 100 has a housing 101, an interior 102, and bolt holes 103. A bus plate holder 104 fits in the interior 102 of the housing and has bolt holes 105. The rotary switch 100 has a large O-ring seal 106, electrical terminals 107, bus plates 108, bus plate connectors 109, and a keyed bus plate connector rotor 110. The rotor 110 is inserted into a rotor rotator 112 with a spring 111. The rotor rotator 112 has an O-ring seal 113 and fits in a cover 114 of the housing 101. The cover 114 also has a knob 116 and bolt holes 115. The large O-ring 106 fits into the cover 114. FIG. 2 shows the rotary switch 100 in an assembled configuration, further showing a bottom end 135 of the bus plate holder 104 extending into the interior 102 of the housing 101.

Figure 3:
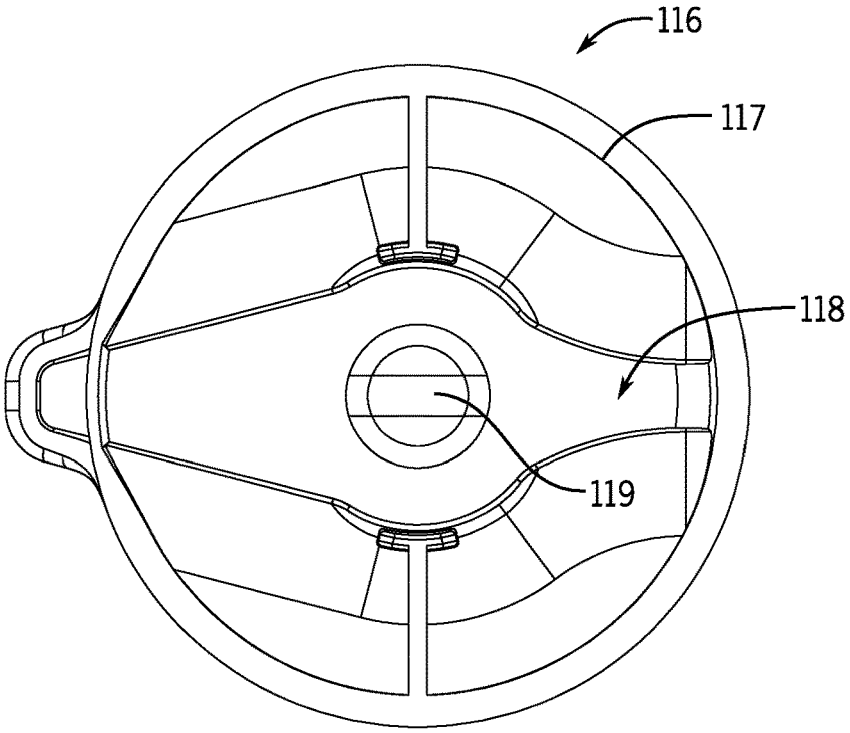
FIG. 3 shows a bottom perspective view a rotary control knob used to place the switch in a first (OFF) position (no electrical terminals connected to each other), a second position (a first and third electrical terminal electrically connected to each other and a second and fourth electrical terminal connected to each other), and in a third position (all four electrical terminals connected to each other).
Figure 4:
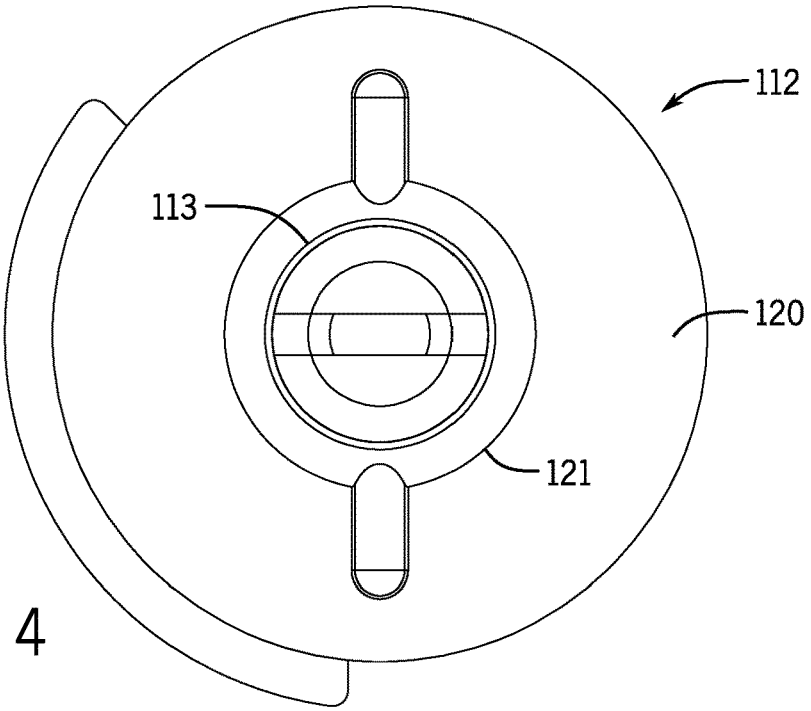
FIG. 4 shows a top perspective view of a rotor rotator.

FIG. 3 shows a bottom perspective view the rotary control knob 116 used to place the switch in a first (OFF) position (no electrical terminals connected to each other), a second position (a first and third electrical terminal electrically connected to each other and a second and fourth electrical terminal connected to each other), and in a third position (all four electrical terminals connected to each other). The bottom end 117 of knob 116 has an interior 118 with a keyed member 119 therein. FIG. 4 shows a top perspective view of the rotor rotator 112. The rotator rotor 112 has a lock member 121 on the top end 120 of the rotor rotator 112. The keyed member 119 of knob 116 fits into the lock member 121 of rotor rotator 112 so that when the knob 116 is rotated the rotor rotator 112 rotates in unison with the knob 116.

Figure 5:
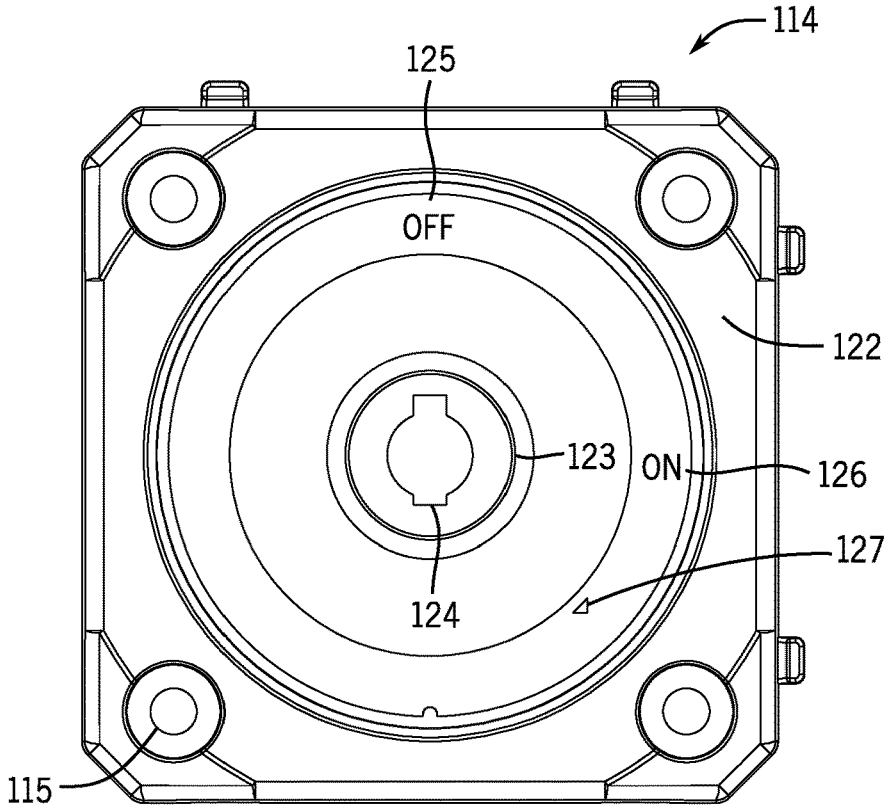
FIG. 5 shows a top view of a cover of a housing of the rotary switch.
Figure 6:
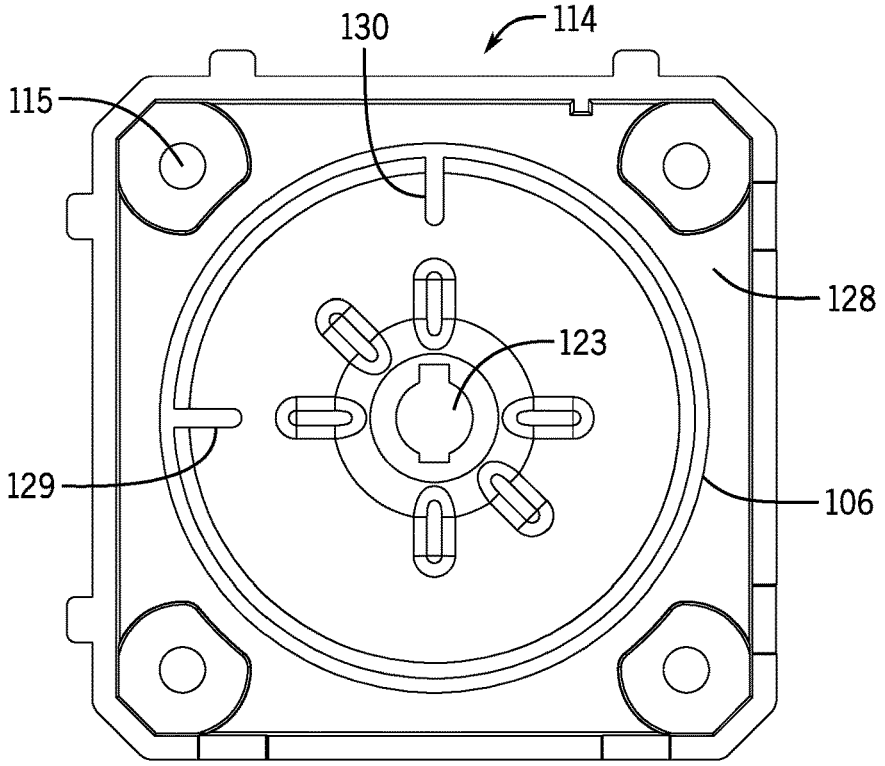
FIG. 6 shows a bottom view of the cover of the housing.
Figure 7A:
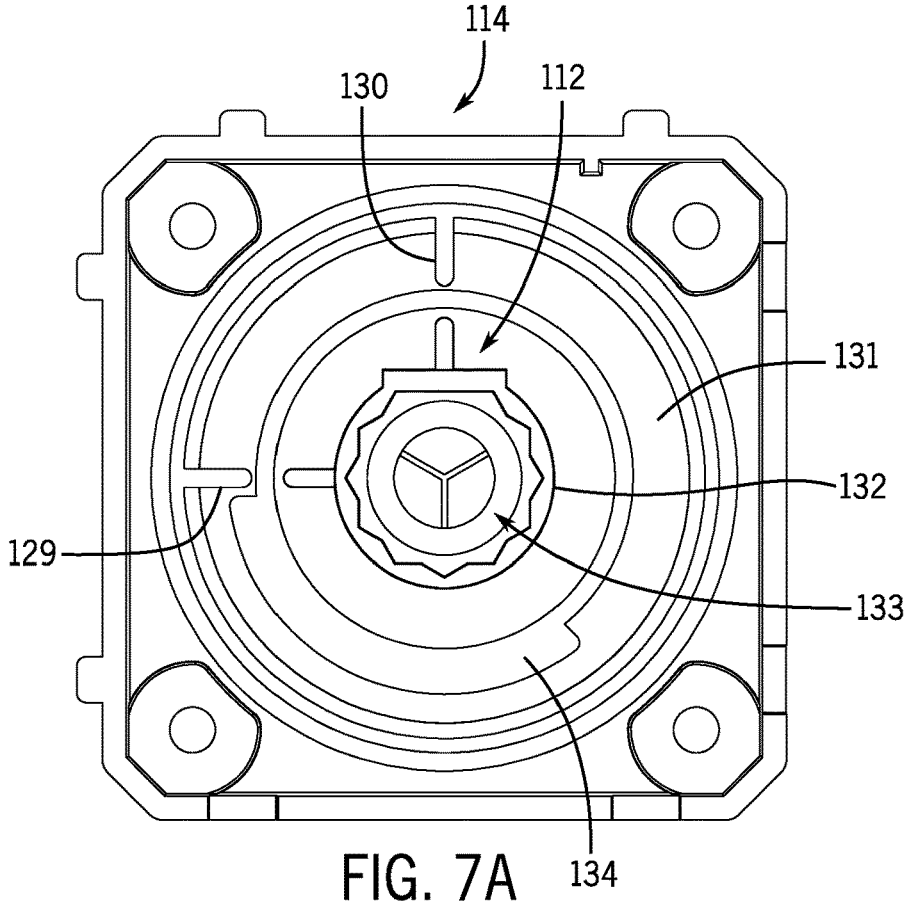
FIG. 7A shows a bottom view of the cover of the housing with a rotor rotator positioned on the bottom side of the cover in a first "OFF" position.
Figure 7B:
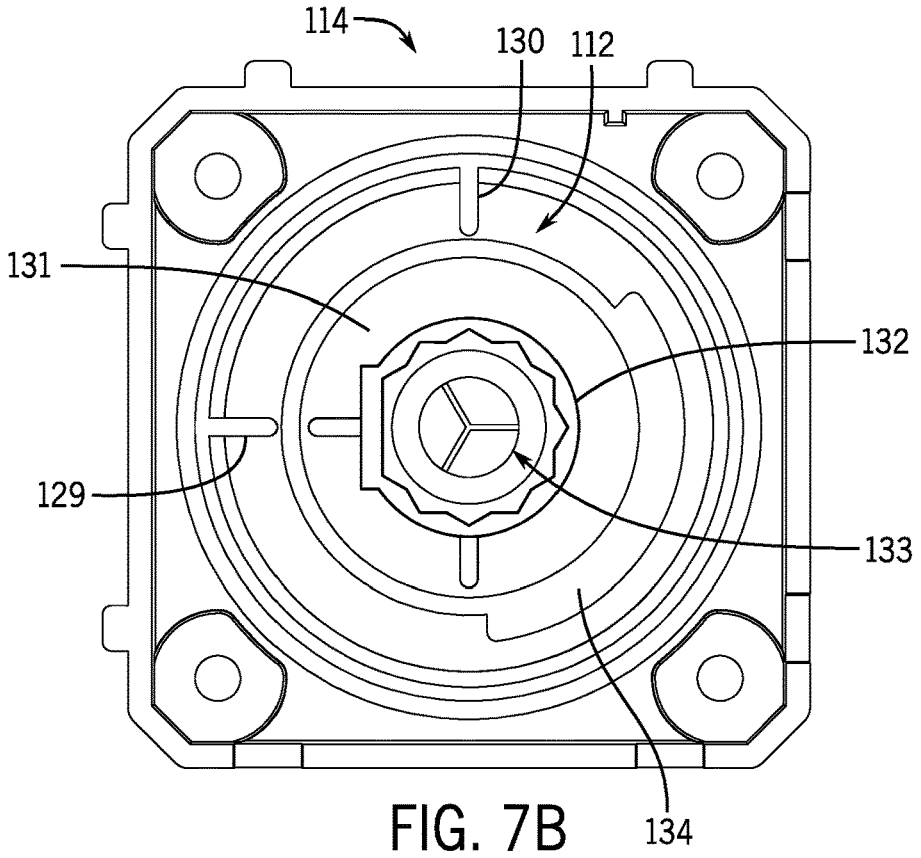
FIG. 7B shows the view of FIG. 7A with the rotor rotator in a second "ON" position.
Figure 7C:
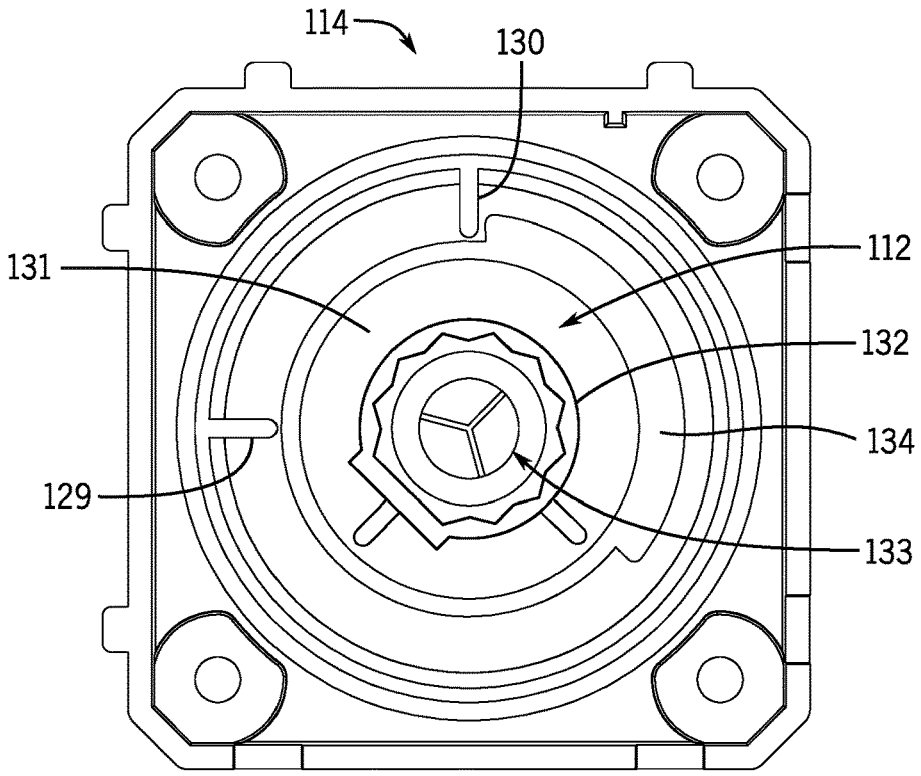
FIG. 7C shows the view of FIG. 7A with the rotor rotator in a third "ON" position.
Figure 8:
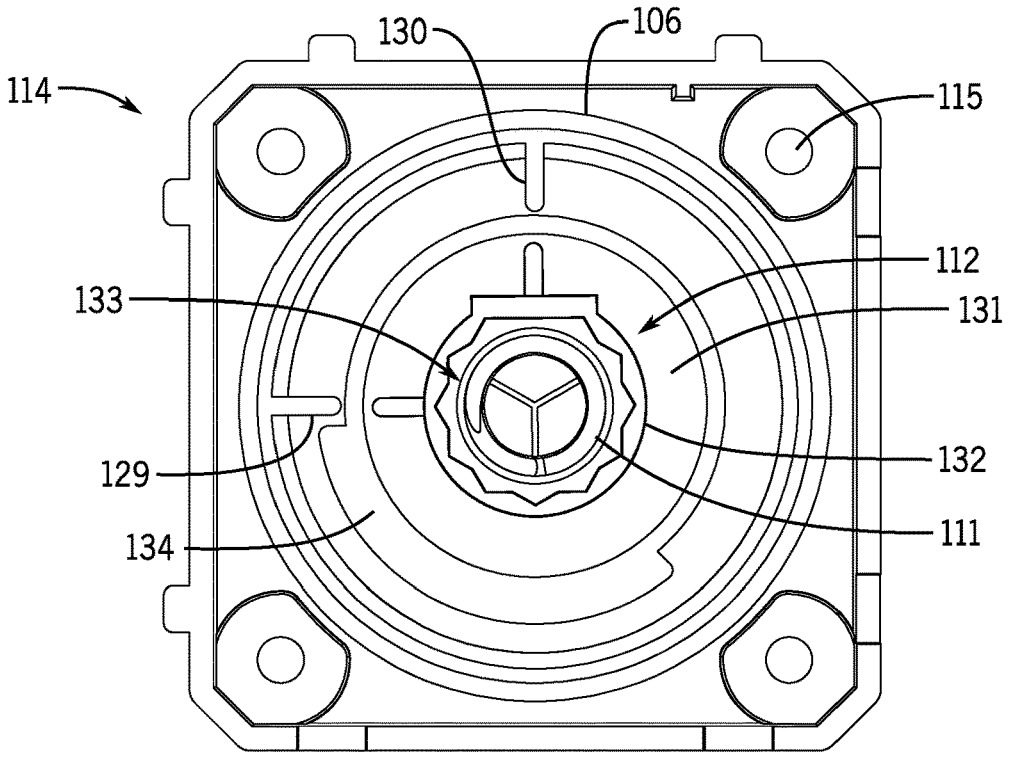
FIG. 8 shows an enlarged view of FIG. 7A with a spring in an interior of the rotor rotator.

FIG. 5 shows a top view of a cover 114 of the housing 101 of the rotary switch 100. The cover 114 has a top surface 122 and a mounting member 123 having a keyed opening 124. Cover 114 shows first position 125 which is an "OFF" position of the switch, a second "ON" position 126, and a third "ON" position 127. FIG. 6 shows a bottom view of the cover 114. A bottom side 128 of the cover 114 has a first stop member 129 and a second stop member 130. The large O-ring seal 106 is shown positioned on the bottom side 128 of the cover 114. FIG. 7A shows a bottom view of the cover 114 with a rotor rotator 112 positioned on the bottom side 128 of the cover in the first "OFF" position 125. A bottom surface 131 of the rotor rotator 112 has a lock housing 132 having an interior 133. A perimeter of the rotor rotator 112 has a flange member 134. A first end of the flange member 134 engages the first stop member 129. FIG. 7B shows the view of FIG. 7A with the rotor rotator 112 in the second position 126. FIG. 7C shows the view of FIG. 7A with the rotor rotator 112 in the third position 127. The second opposite end of the flange member 134 engages the second stop member 130. FIG. 8 shows an enlarged view of FIG. 7A with a spring 111 in the interior 133 of the lock housing 132.

Figure 9:
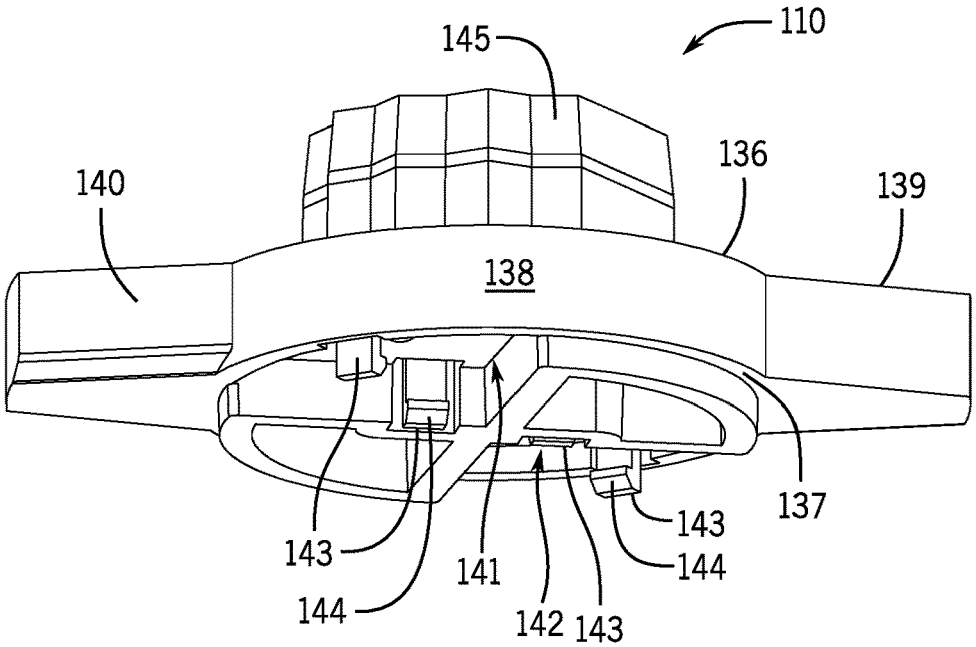
FIG. 9 shows a bottom, side perspective view of a rotor.
Figure 10:
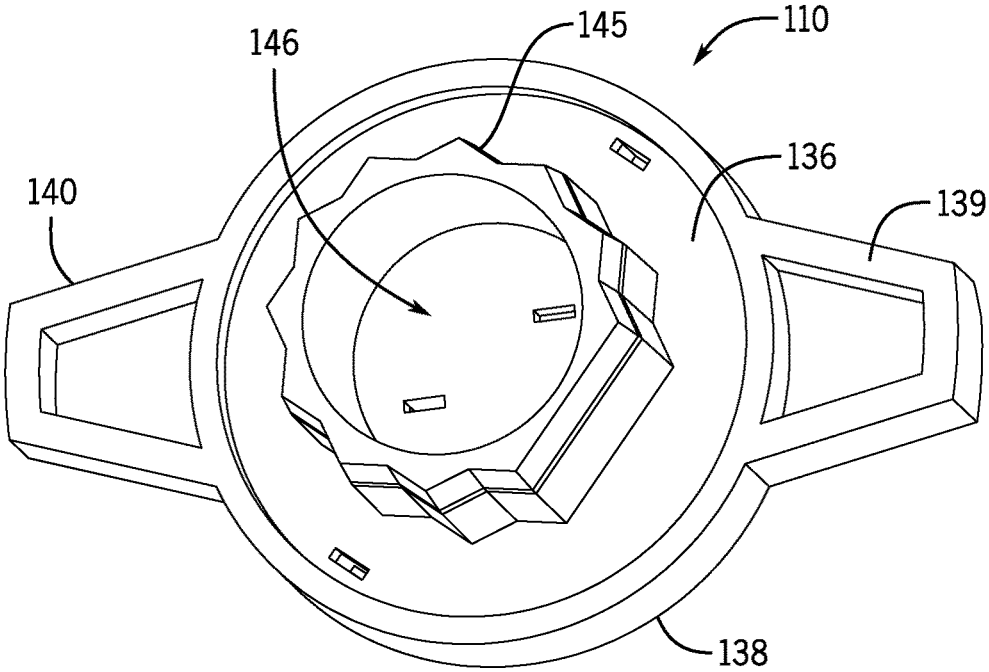
FIG. 10 shows a top perspective view of the rotor.
Figure 11:
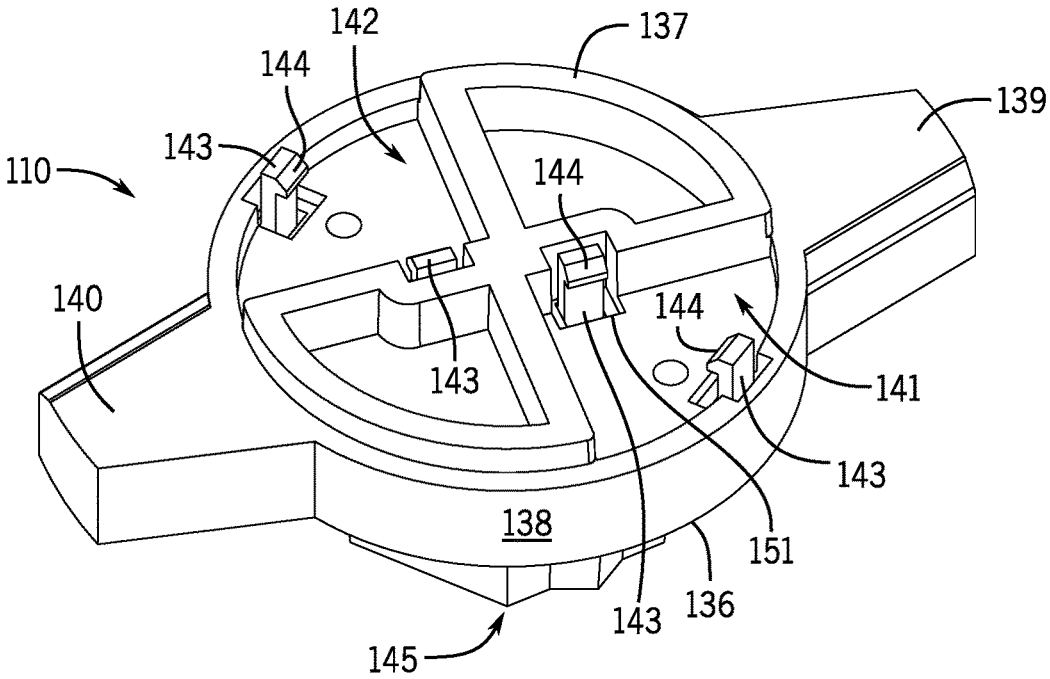
FIG. 11 shows a bottom perspective view of the rotor.

FIG. 9 shows a bottom, side perspective view of a rotor 110. The rotor 110 has a top surface 136, a bottom surface 137, and sides 138. Extending from a side 138 is a first support member 139 and a second support member 140. On the bottom surface 137 is a first bus plate connector chamber 141 and a second bus plate connector chamber 142, each chamber having flexible retainers 143 for the bus plate connectors 109. Each retainer 143 has a lip member 144. On the top surface 136 is a keyed member 145. FIG. 10 shows a top perspective view of the rotor 110. The keyed member 145 has an interior 146. The spring 111 fits in the interior 146 of the keyed member 145, and the keyed member 145 fits into the interior 133 of the lock housing 132 on the bottom 131 of the rotor rotator 112. FIG. 11 shows a bottom perspective view of the rotor 110 in greater detail.

Figure 12:
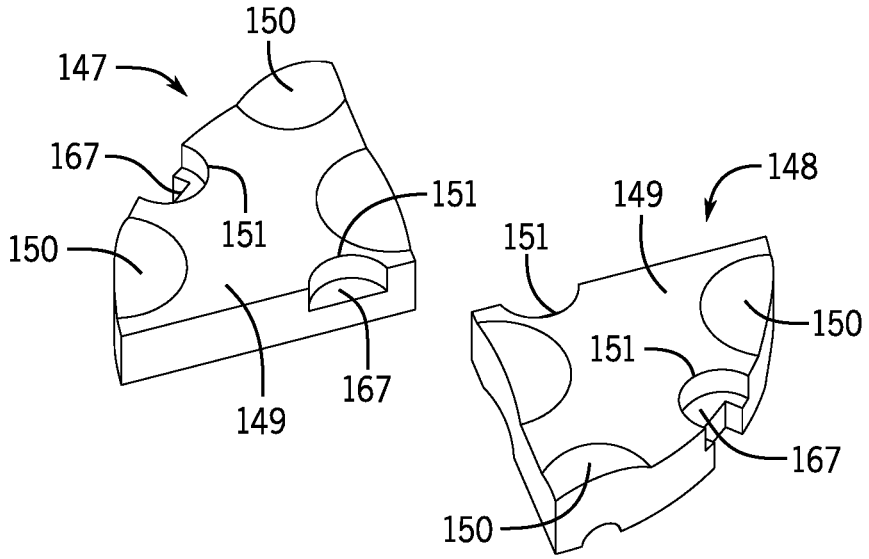
FIG. 12 shows a bottom perspective view of bus plate connectors that are shaped to fit in the rotor.
Figure 13:
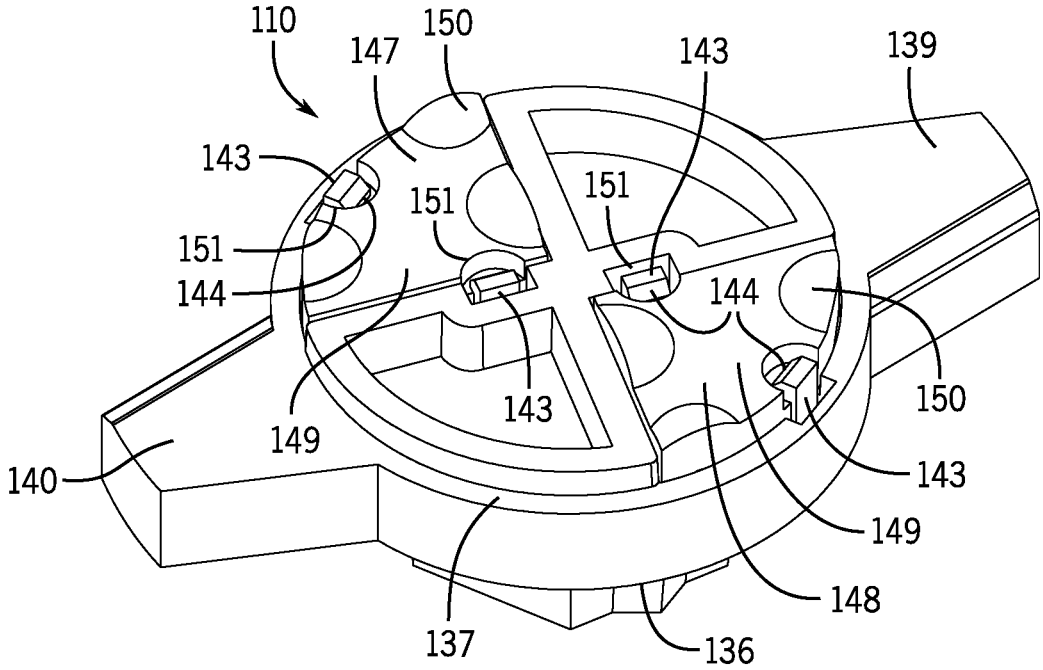
FIG. 13 shows a bottom perspective view of the rotor with the bus plate connectors retained in the rotor.

FIG. 12 shows a bottom perspective view of a first bus plate connector 147 and a second bus plate connector 148 that are shaped to fit in the bus plate connector chambers 141 and 142 of rotor 110. The bottom surfaces 149 of the bus plate connectors 147 and 148 have protrusions 150 for facilitating electrical contact. Sides of the bus plate connectors 147 and 148 have receptacles 151. Receptacles 151 have a ledge 167 which is engaged by the lip members 144 on retainers 143. FIG. 13 shows a bottom perspective view of the rotor 110 with the bus plate connectors 147 and 148 retained in the rotor 110. The lip members 144 extend into the receptacles 151, fit over the ledges 167, and reversibly retain the bus plate connectors 147 and 148 in the chambers 141 and 142. The bus plate connectors 147 and 148 are not able to drop out of the chambers 141 and 142 because the lip members 144 hold the bus plate connectors 147 and 148 in the chambers 141 and 142 in any orientation of the rotor 110. The lip members 144 may be beveled to facilitate pressing the bus plate connectors 147 and 148 into the chambers 141 and 142.

Figure 14:
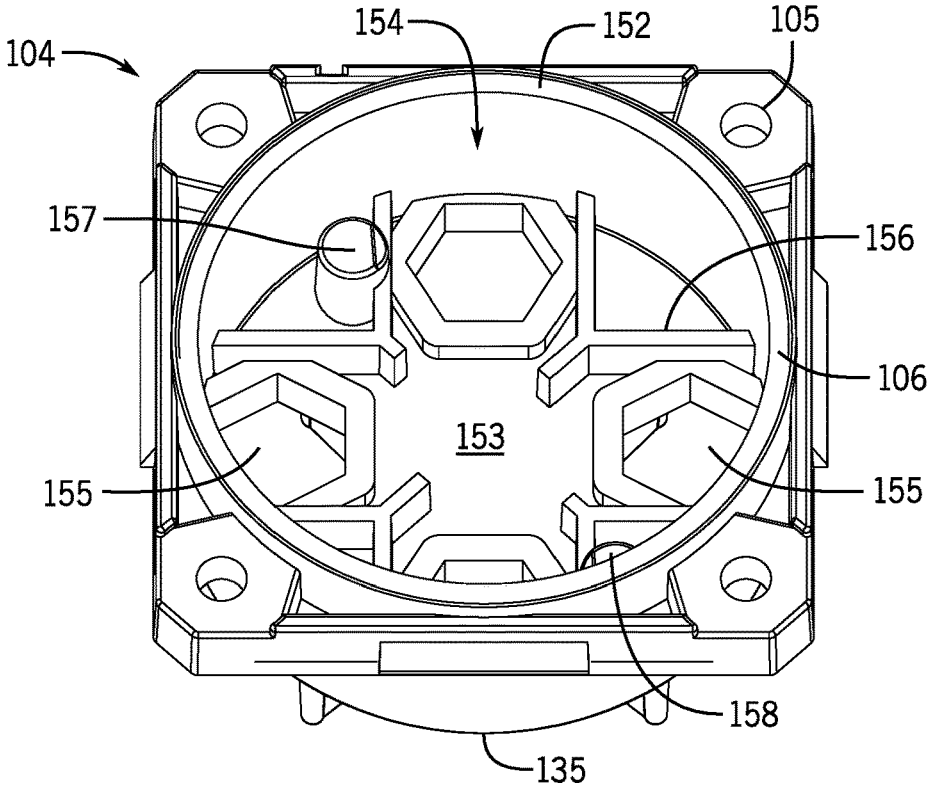
FIG. 14 shows a top perspective view of a bus plate holder having support posts for mounting support members of the rotor.

FIG. 14 shows a top perspective view of the bus plate holder 104. Bus plate holder 104 as a top surface 152 and a bottom surface 153 defining an interior 154. The bottom surface 153 has openings 155 for insertion of electrical terminals 107 and has support structures 156 for bus plates 108. The bottom surface 153 has a first support post 157 and a second support post 158 for supporting the first support member 139 and the second support member 140, respectively, of the rotor 110 when the rotor 110 is in the first (OFF) position (see FIG. 17).

Figure 15:
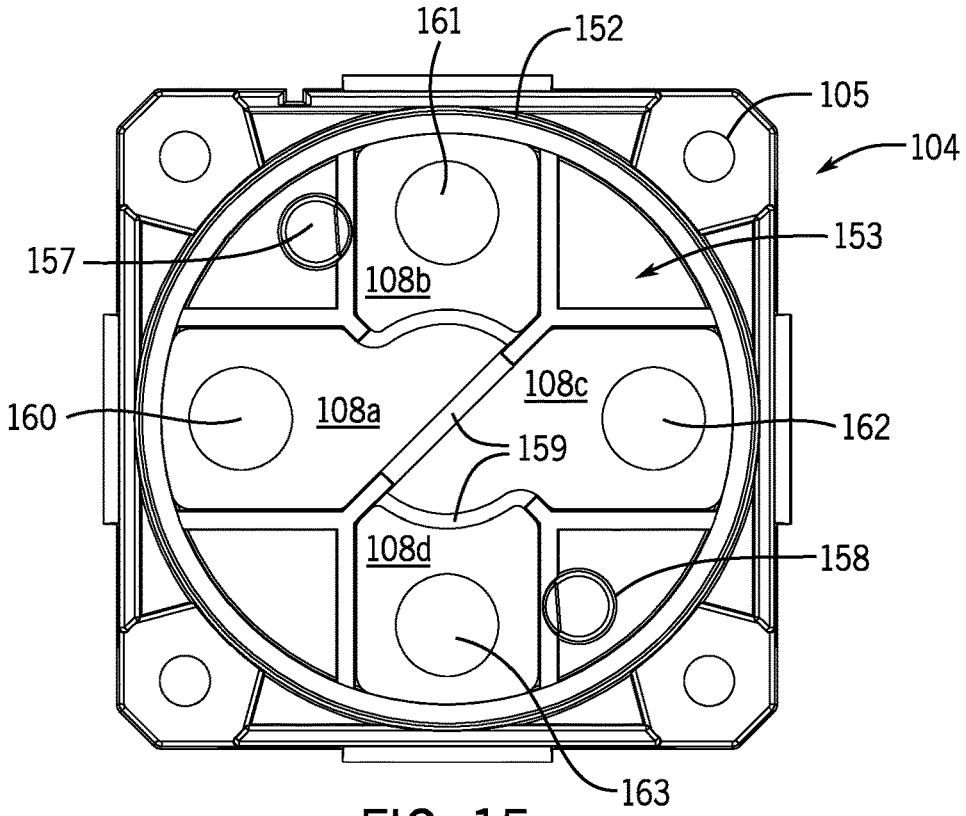
FIG. 15 shows a top perspective view of the bus plate holder with four bus plates, each attached electrically to an electrical terminal.

FIG. 15 shows a top perspective view of the bus plate holder 104 with four bus plates, each attached electrically to an electrical terminal. A first bus plate 108*a* is attached to a first electrical terminal 160. A second plate 108*b* is attached to a second electrical terminal 161. A third bus plate 108*c* is attached to a third electrical terminal 162. A fourth bus plate 108*d* is attached to a fourth electrical terminal 163. There is a gap 159 between the bus plates so that the bus plates do not make electrical contact with each other.

Figure 16A:
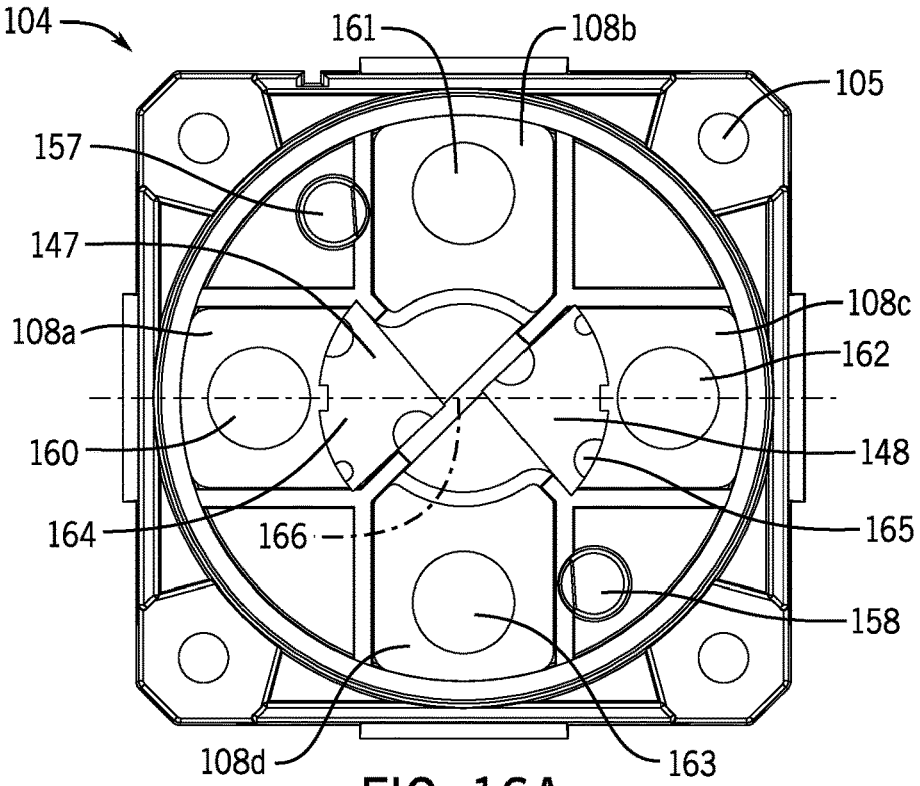
FIG. 16A shows the view of FIG. 15, illustrating the location of a first bus plate connector over a first bus plate and a second bus plate connector over a third bus plate when the rotary switch is in a first "OFF" position, wherein the bus plate connectors are not making electrical contact with the bus plates.

FIG. 16A shows the view of FIG. 15, illustrating the location of the first bus plate connector 147 over the first bus plate 108*a* and the second bus plate connector 148 over the third bus plate 108*c* when the rotary switch 100 is in the first "OFF" position 125. In this configuration, the bus plate connectors 147 and 148 do not make electrical contact with the bus plates 108*a* and 108*c* because they are lifted up and off the bus plates 108*a* and 108*c* by the first support member 139 and the second support member 140 of the rotor 110 being rotated upon the first support post 157 and the second support post 158, respectively (see FIGS. 17 and 18).

Figure 16B:
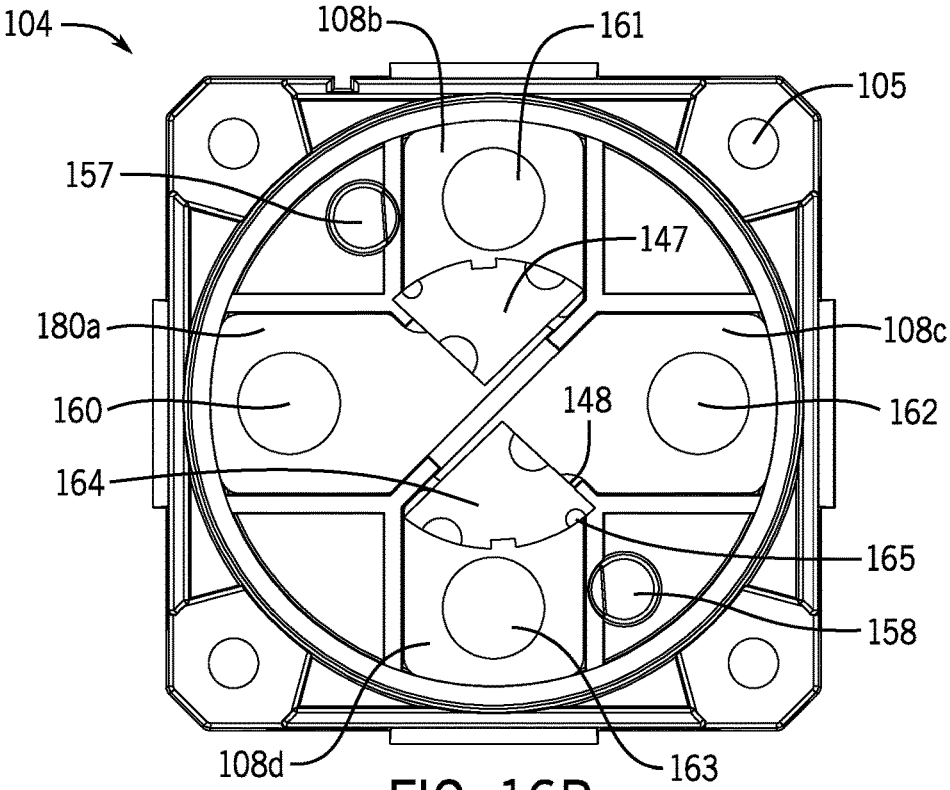
FIG. 16B shows the view of FIG. 15, illustrating the location of a first bus plate connector on a first and a second bus plate and a second bus plate connector on a third and fourth bus plate when the rotary switch is in the second position, wherein the bus plate connectors are making electrical contact with the bus plates.

FIG. 16B shows the view of FIG. 15, illustrating the location of the first bus plate connector 147 on the first bus plate 108*a* and on the second bus plate 108*b* and the second bus plate connector 148 on the third bus plate 108*c* and on the fourth bus plate 108*d* when the rotary switch 100 is in the second position 126. In this configuration, the first support member 139 and second support member 140 of the rotor 110 are rotated off the first support post 157 and the second support post 158. The spring 111 in the interior 146 of rotor 111 biases (pushes) the rotor 111 downward, thereby pushing the first bus plate connector 147 and the second plus plate connector 148 onto the bus plates, thereby electrically connecting the first bus plate 108*a* to the second bus plate 108*b* and electrically connecting the third bus plate 108*c* to the fourth bus plate 108*d*. Consequently, the first electrical terminal 160 is connected electrically to the second electrical terminal 161 and the third electrical terminal 162 is connected electrically to the 4th electrical terminal 163.

Figure 16C:
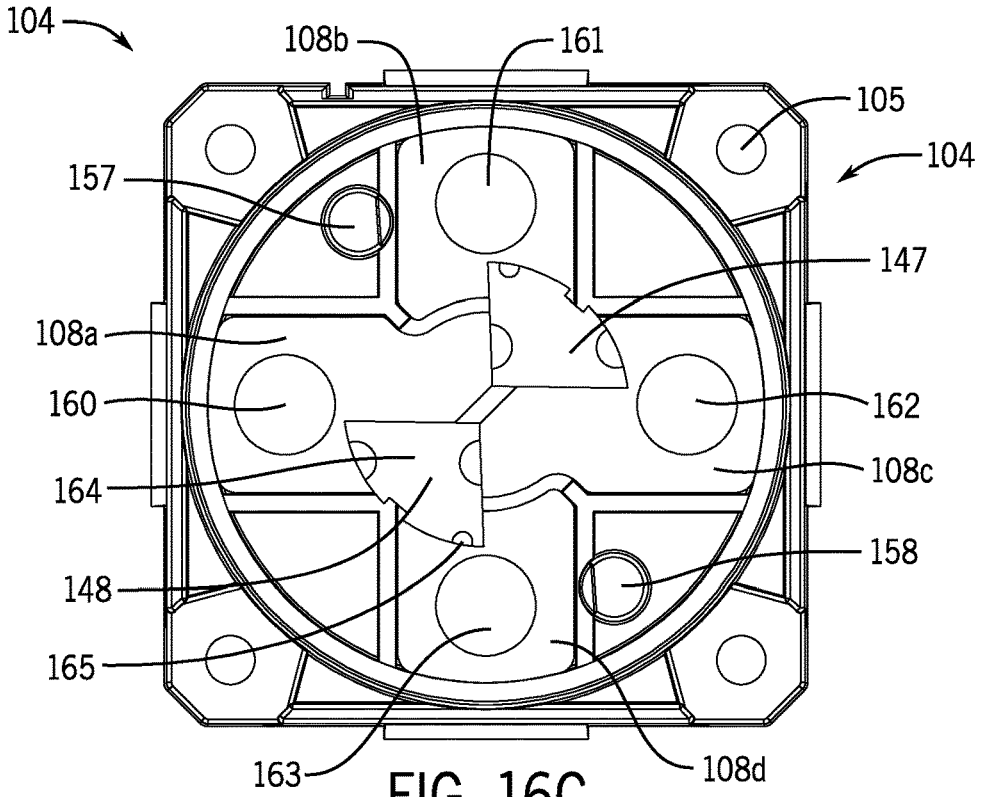
FIG. 16C shows the view of FIG. 15, illustrating the location of a first bus plate connector on a first, second, and third bus plate and a second bus plate connector on a third and fourth and first bus plate when the rotary switch is in the third position, wherein the bus plate connectors are making electrical contact with the bus plates.

FIG. 16C shows the view of FIG. 15, illustrating the location of the first bus plate connector on the first, second, and third bus plates and the second bus plate connector on the third and fourth and first bus plates when the rotary switch is in the third position 127. In this configuration, the support members 139 and 140 of the rotor 110 are still off the support posts 157 and 158. The first bus plate connector 147 is connected to the first bus plate 108*a*, the second bus plate 108*b*, and the third bus plate 108*c*. The second bus plate connector 148 is connected to the third base plate 108*c*, the fourth bus plate 108*d*, and the first bus plate 108*a*. Thus, all the bus plates 108*a*-108*d* are electrically connected to each other and all the electrical terminals 160-163 are electrically connected together. When the rotor 110 is rotated back to the first position 125 the support members 139 and 140 are rotated back up onto the support posts 157 and 158 where the bus plate connectors 147 and 148 are lifted up off the bus plates. The bus plate connectors 147 and 148, thus, do not make any electrical connection with the bus plates when the switch 100 is in the off position 125.

Figure 17:
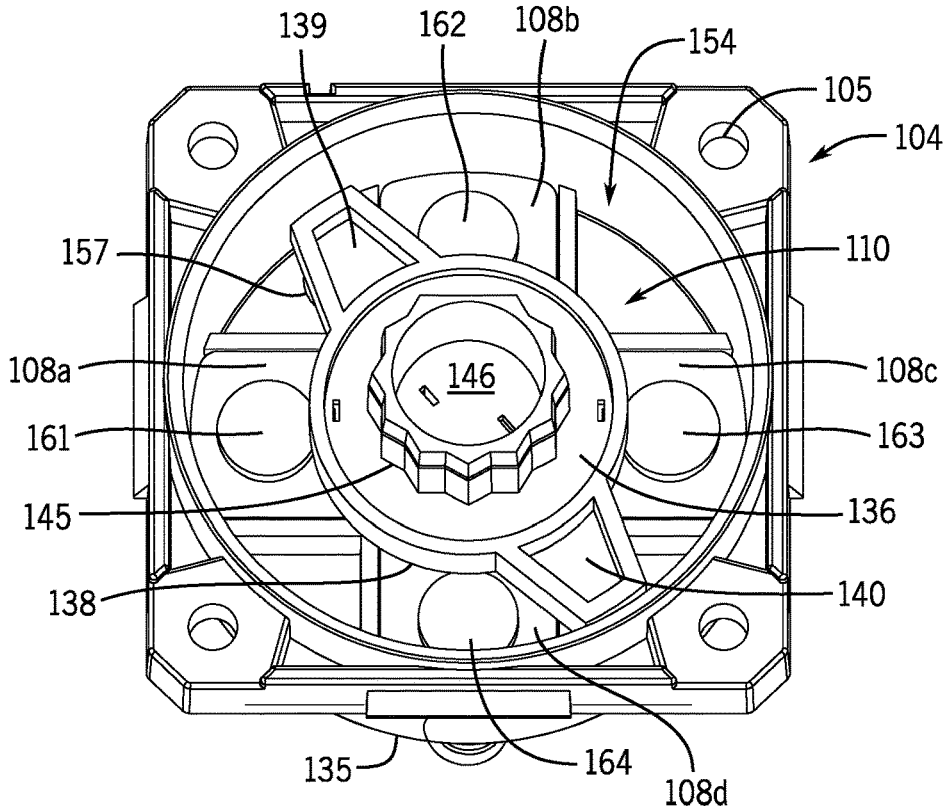
FIG. 17 shows the view of FIG. 15 with the rotor positioned in the interior of the bus plate holder in the first (OFF) position, wherein the support members of the rotor are mounted on the support posts in the bus plate holder.

FIG. 17 shows the view of FIG. 15 with the rotor 110 positioned in the interior 154 of the bus plate holder 104 in the first (OFF) position 125. The support members 139 and 140 of the rotor 110 are shown mounted onto the support posts 157 and 158.

Figure 18:
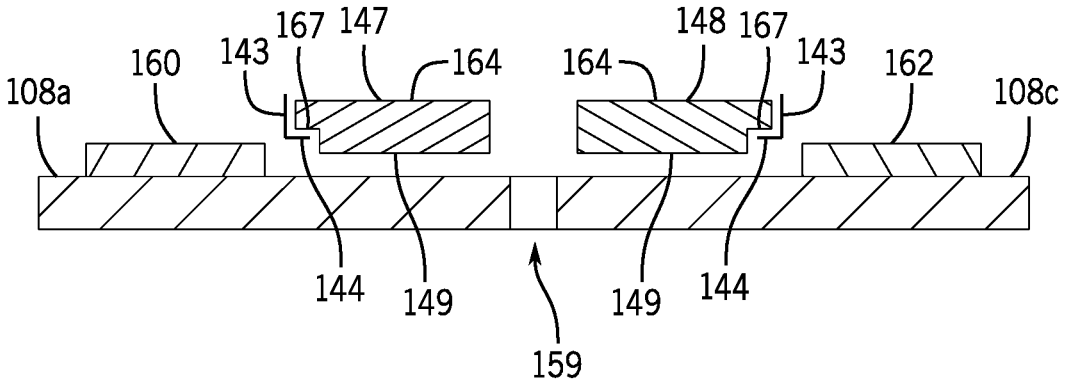
FIG. 18 is a sectional view diagram along the dashed line shown in FIG. 16A, illustrating the bus connecting plates suspended above the bus plates, making no electrical connection with the bus plates, when the rotary switch is in the first (OFF) position.

FIG. 18 is a sectional view diagram along the dashed line 166 shown in FIG. 16A, illustrating the bus plate connectors 147 and 148 suspended above the bus plates 108*a* and 108*c* making no electrical connection with the bus plates, when the rotary switch is in the first (OFF) position. Lip members 144 on retainers 143 are shown holding the bus plates 147 and 148 in place above the bus plates 108*a* and 108*c*. The distance between the bus plate connectors 147 and 148 and the bus plates 108*a* and 108*c* is between 1.0-0.25 mm, preferably, 0.45 mm.

Although the rotor has been described as making connections in a rotary switch having four electrical terminals, the rotor will also work with a rotary switch having two terminals (a two-position switch) or three terminals (a three-position switch) by simply limiting the number of electrical terminals in the rotary switch and/or by limiting the number of bus plate connectors.

The foregoing description illustrates and describes the disclosure. Additionally, the disclosure shows and describes only the preferred embodiments but, as mentioned above, it is to be understood that the preferred embodiments are capable of being formed in various other combinations, modifications, and environments and are capable of changes or modifications within the scope of the invention concepts as expressed herein, commensurate with the above teachings and/or the skill or knowledge of the relevant art. The embodiments described herein above are further intended to explain the best modes known by applicant and to enable others skilled in the art to utilize the disclosure in such, or other, embodiments and with the various modifications required by the particular applications or uses thereof. Accordingly, the description is not intended to limit the invention to the form disclosed herein. Also, it is intended that the appended claims be construed to include alternative embodiments. It will be further understood that various changes in the details, materials, and arrangements of the parts which have been described and illustrated above in order to explain the nature of this invention may be made by those skilled in the art without departing from the principle and scope of the invention as recited in the following claims.

The invention claimed is:

1. A rotor system for a multi-pole rotary electrical switch, comprising:

a) a rotor having a top surface and a bottom surface with a keyed member on the top surface, the keyed member having an interior;

b) one or two bus plate connectors held in chambers on the bottom surface of the rotor; and c) retainers in the chambers constructed to engage sides of the one or two bus plate connectors, wherein the retainers are constructed to prevent the one or two bus plate connectors from dropping out of the chambers when the bus plate connectors are placed above two to four bus plates in a bus plate holder to place the multi-pole rotary electrical switch in an "OFF" position, wherein there are no electrical connections between the one or two bus plate connectors and the two to four bus plates in the "OFF" position.

2. The rotor system of claim 1, further comprising a first support member extending from a first side of the rotor and a second support member extending from an opposite side of the rotor to support the one or two bus plate connectors above the two to four bus plates in the bus plate holder.

3. The rotor system of claim 2, wherein the first support member and the second support member are constructed so that when the rotor is rotated to the "OFF" position the first support member and the second support member are rotated onto a first support post and onto a second support post, respectively, positioned in the bus plate holder.

4. The rotor system of claim 3, wherein the first support member and the second support member are constructed so that when the rotor is rotated to an "ON" position the first support member and the second support member are rotated off the first support post and the second support post, respectively, and the one or two bus plate connectors are pressed against the two to four bus plates by a spring in the interior of the keyed member, thereby making electrical connections between the one or two bus plate connectors and the two to four bus plates.

5. The rotor system of claim 1, further comprising sides of the one or two bus plate connectors having receptacles to engage the retainers.

6. The rotor system of claim 5, further comprising each of the retainers having a lip member that engages a ledge in the receptacle.

7. A rotor system for a multi-pole rotary electrical switch, comprising:

a) a rotor having a top surface and a bottom surface with a keyed member on the top surface, the keyed member having an interior;

b) one or two bus plate connectors held in chambers on the bottom surface of the rotor;

c) retainers in the chambers constructed to engage sides of the one or two bus plate connectors, wherein the retainers are constructed to prevent the one or two bus plate connectors from dropping out of the chambers when the bus plate connectors are placed above two to four bus plates in a bus plate holder to place the multi-pole rotary electrical switch in an "OFF" position, wherein there are no electrical connections between the one or two bus plate connectors and the two to four bus plates in the "OFF" position;

d) a first support member extending from a first side of the rotor and a second support member extending from an opposite side of the rotor to support the one or two bus plate connectors above the two to four bus plates in the bus plate holder; and e) sides of the one or two bus plate connectors having receptacles to engage the retainers.

8. The rotor system of claim 7, wherein the first support member and the second support member are constructed so that when the rotor is rotated to the "OFF" position the first support member and the second support member are rotated onto a first support post and onto a second support post, respectively, positioned in the bus plate holder.

9. The rotor system of claim 8, wherein the first support member and the second support member are constructed so that when the rotor is rotated to an "ON" position the first support member and the second support member are rotated off the first support post and the second support post, respectively, and the one or two bus plate connectors are pressed against the two to four bus plates by a spring in the interior of the keyed member, thereby making electrical connections between the one or two bus plate connectors and the two to four bus plates.

10. The rotor system of claim 8, further comprising each of the retainers having a lip member that engages a ledge in the receptacle.

11. A rotor system for a multi-pole rotary electrical switch, comprising:

a) a rotor having a top surface and a bottom surface with a keyed member on the top surface, the keyed member having an interior;

b) one or two bus plate connectors held in chambers on the bottom surface of the rotor;

c) retainers in the chambers constructed to engage sides of the one or two bus plate connectors, wherein the retainers are constructed to prevent the one or two bus plate connectors from dropping out of the chambers when the bus plate connectors are placed above two to four bus plates in a bus plate holder to place the multi-pole rotary electrical switch in an "OFF" position, wherein there are no electrical connections between the one or two bus plate connectors and the two to four bus plates in the "OFF" position;

d) a first support member extending from a first side of the rotor and a second support member extending from an opposite side of the rotor to support the one or two bus plate connectors above the two to four bus plates in the bus plate holder, wherein the first support member and the second support member are constructed so that when the rotor is rotated to the "OFF" position the first support member and the second support member are rotated onto a first support post and onto a second support post, respectively, positioned in the bus plate holder and wherein the first support member and the second support member are constructed so that when the rotor is rotated to an "ON" position the first support member and the second support member are rotated off the first support post and the second support post, respectively, and the one or two bus plate connectors are pressed against the two to four bus plates by a spring in the interior of the keyed member, thereby making electrical connections between the one or two bus plate connectors and the two to four bus plates; and e) sides of the one or two bus plate connectors having receptacles to engage the retainers.

12. The rotor system of claim 11, further comprising each of the retainers having a lip member that engages a ledge in the receptacle.

* * * * *